US009964113B2

(12) United States Patent
Westberg et al.

(10) Patent No.: US 9,964,113 B2
(45) Date of Patent: May 8, 2018

(54) OMNIRISE HYDROMAG "VARIABLE SPEED MAGNETIC COUPLING SYSTEM FOR SUBSEA PUMPS"

(71) Applicant: FUGLESANGS SUBSEA AS, Oslo (NO)

(72) Inventors: Tommy Westberg, Torsby (SE); Alexander Fuglesang, Oslo (NO)

(73) Assignee: Fuglesangs Subsea AS, Oslo (NO)

( * ) Notice: Subject to any disclaimer, the term of this patent is extended or adjusted under 35 U.S.C. 154(b) by 0 days. days.

(21) Appl. No.: 14/973,960

(22) Filed: Dec. 18, 2015

(65) Prior Publication Data

US 2016/0333677 A1 Nov. 17, 2016

Related U.S. Application Data

(60) Provisional application No. 62/159,526, filed on May 11, 2015.

(51) Int. Cl.
*F04D 13/08* (2006.01)
*F04D 25/06* (2006.01)
(Continued)

(52) U.S. Cl.
CPC ..... *F04D 25/0686* (2013.01); *E21B 43/128* (2013.01); *F04D 13/022* (2013.01);
(Continued)

(58) Field of Classification Search
CPC ..... F04D 13/02; F04D 13/021; F04D 13/024; F04D 13/04; F04D 25/02; F04D 25/022;
(Continued)

(56) References Cited

U.S. PATENT DOCUMENTS 3,873,244 A 3/1975 Jaggi
4,208,171 A * 6/1980 Jonsson ..... F04D 13/022 417/15

(Continued)

FOREIGN PATENT DOCUMENTS

WO WO 2010014640 A2 * 2/2010 ..... H02K 1/278
WO 2014168488 A1 10/2014
WO WO 2014168488 A1 * 10/2014 ..... F04D 25/026

OTHER PUBLICATIONS

PCT Search Report & Written Opinion (PCT/IB2016/001303), dated Oct. 26, 2016.

*Primary Examiner* — Dominick L Plakkoottam
*Assistant Examiner* — Chirag Jariwala
(74) *Attorney, Agent, or Firm* — Bracewell LLP; Douglas W. Rommelmann

(57) ABSTRACT

A unique low cost and efficient submersible, hermetically sealed, variable speed system intended to drive submersible boosting units. The system includes a unique combination of a liquid filled electrical motor connected to a hydraulic coupling and a magnetic coupling driver section, in a hermetically sealed container, with a magnetic coupling follower driving a booster unit. The system further includes integrated cooling, lubrication and control functionality. The drive unit has an actuating system connected to internal guide vanes which controls the liquid flow between the pump impeller and turbine wheel of the hydrodynamic coupling and hence the torque and speed. The combined system is a sealed seal-less and topside-less submersible drive unit that can operate in harsh subsea environments. The drive unit opens up for use of thin walled pressure casings and low pressure electrical penetrators.

43 Claims, 3 Drawing Sheets

(51) Int. Cl.

| | |
|---|---|
| ***E21B 43/12*** | (2006.01) |
| ***F04D 13/04*** | (2006.01) |
| ***F04D 25/02*** | (2006.01) |
| ***F04D 25/04*** | (2006.01) |
| ***F04D 29/58*** | (2006.01) |
| ***F04D 13/02*** | (2006.01) |
| ***F04D 13/06*** | (2006.01) |

(52) U.S. Cl.
CPC ..... *F04D 13/023* (2013.01); *F04D 13/024* (2013.01); *F04D 13/025* (2013.01); *F04D 13/027* (2013.01); *F04D 13/04* (2013.01); *F04D 13/0653* (2013.01); *F04D 13/086* (2013.01); *F04D 25/022* (2013.01); *F04D 25/026* (2013.01); *F04D 25/045* (2013.01); *F04D 29/5806* (2013.01)

(58) Field of Classification Search
CPC ..... F04D 25/026; F04D 25/04; F04D 25/045; F04D 13/023; F04D 13/025; F04D 13/027; F04D 13/086; F04D 13/0653; F04D 13/022; F04D 25/0686; F04D 29/5806; E21B 43/12; E21B 43/126; E21B 43/128; E21B 43/129
USPC ..... 417/423.3, 423.8, 372, 223, 319, 420, 417/424.1, 424.2; 464/24, 29
See application file for complete search history.

(56) References Cited

U.S. PATENT DOCUMENTS

| | | | | |
|---|---|---|---|---|
| 6,224,330 | B1 * | 5/2001 | Larsson | F02B 41/10 415/121.1 |
| 8,523,540 | B2 * | 9/2013 | Eide | 417/423.8 |
| 2009/0277197 | A1 * | 11/2009 | Gambiana | F25B 39/028 62/115 |
| 2010/0150740 | A1 * | 6/2010 | Veland | F04B 53/164 417/53 |
| 2012/0222633 | A1 * | 9/2012 | Barthelmas | F01P 5/12 123/41.44 |
| 2012/0308408 | A1 * | 12/2012 | Rosvold | F04D 25/0686 417/199.1 |
| 2013/0318965 | A1 * | 12/2013 | Ekanayake | F02B 47/08 60/605.1 |
| 2014/0105765 | A1 * | 4/2014 | Tonnessen | F04D 25/0686 417/372 |
| 2014/0203640 | A1 * | 7/2014 | Stinessen | H02J 3/22 307/31 |
| 2015/0114632 | A1 * | 4/2015 | Romer | E21B 4/003 166/250.15 |
| 2015/0148972 | A1 * | 5/2015 | Blaumann | F04D 1/04 700/282 |
| 2015/0184498 | A1 * | 7/2015 | Twidale | F04C 2/1073 166/250.15 |
| 2015/0354574 | A1 * | 12/2015 | Homstvedt | F04D 13/024 417/423.3 |

* cited by examiner

OMNIRISE HYDROMAG "VARIABLE SPEED MAGNETIC COUPLING SYSTEM FOR SUBSEA PUMPS"

CROSS-REFERENCE TO RELATED APPLICATIONS

This application claims priority to U.S. Provisional Application No. 62/159,526, filed May 11, 2015. Applicant incorporates by reference herein U.S. Provisional Application No. 62/159,526 in its entirety.

BACKGROUND OF THE INVENTION

1. Field of the Invention

The present invention relates generally to motor driven pumps and compressors, and more particularly to submersible motor driven pumps and compressors having a torque transmitting assembly.

2. Description of the Related Art

The subsea industry is transitioning from being a new frontier where only large multi-national firms developing new drilling and completion technologies to explore and develop new hydrocarbon resources in thousands of meters of water and without existing infrastructure could participate to a more mature market with many participating companies utilizing hundreds of high specification drilling rigs, ever improving drilling and completion technologies and growing infrastructure.

With this maturity in the subsea market, new challenges are arising. Those challenges include maximizing production from maturing and marginal fields, lowering costs to be competitive with over resource plays such as shale oil in North America. Cost reductions have also become important with volatile commodity pricing. Costs saving programs being adopted by operators are seeking methods to reduce overall costs of subsea development by 30% or more. Included in these programs are challenges to product and service providers to provide lower cost solutions that are easier, simpler and quicker to implement and that reduce the need for many existing and high cost drilling, completion and production processes.

One area of transition in the subsea that is in need of new technical solutions to address the demands of the clients is in the area of subsea processing and pumps. Traditionally, much of the subsea production and processing activities occurred on topside platforms and production units connected to subsea christmas trees and manifolds through pipelines and other tubular products. This configuration requires large pumps and ancillary equipment to assist in the transportation of oil, natural gas and water to separation units, processors and injection and water disposal units. The need for these items of equipment contributes to higher costs and complexity, which in turn affects reliability and ultimate profitability.

The aging of the world's subsea fields has also created subsea pumping challenges as older fields and reservoirs begin producing greater levels of water and require increased pressure to produce. The use of seabed pumps has been shown to extend the life of a reservoir and improve field economics by helping maintain pressure through either the injection of water into the reservoir or directly boosting the flow from the reservoir. Maturing wells also provide greater challenges for pumping fluids consisting of higher proportions of gas to oil that are more difficult for traditional pumps to efficiently move.

Subsea production pumps generally fall into the following types:

Centrifugal: Helico-axial (Axial flow). These subsea pumps have been proven for large applications. These pumps are generally very large, have low efficiency and need high shaft speeds (up to 6500 rpm).

Centrifugal: Mixed flow. These pumps have been qualified for subsea applications. They generally provide higher efficiency and need lower shaft speeds (up to 5400 rpm).

Twin-screw: These pumps have on a few occasions been installed for seabed pumping applications and tested in downhole applications. They are generally highly efficient when handling high viscosity fluids, but have historically had low reliability, particularly in the presence of particles.

Electrical submersible pumps: These pumps are mostly of centrifugal type but can also be of positive displacement type and have generally been utilized for downhole applications and work well with high volumes. They have been used for selected injection applications.

Each of these types of pumps present certain benefits as well as detriments, including their ability to lift heavy oil, operate in deep water, handle high gas to waster fractions and ease of maintenance.

Each of the current pump solutions also has drawbacks due to their high power requirements and complex sealing designs for the deepwater. The high power requirements of the pumps impose a need for large electrical umbilical lines and variable speed drives to supply and manage the needed power. Similarly, required operating water depths have stretched the pressure sealing capabilities of the equipment by their reliance on sensitive high pressure mechanical seals and associated complex barrier fluid systems for lubrication.

In recent years, technological advances have enabled greater use of subsea pumps and processing. These systems, however, still require expensive and large topside equipment to operate and cannot be economically used for smaller or marginal field developments such as "brownfields" or smaller "green fields". In addition, larger and more complex equipment create challenges in enabling operators to engage in early field production.

There is therefore a need for a high performing and economical subsea pump system with the following characteristics: (i) is deployed subsea and can be operated without topside hydraulic pressure controls and large separate variable speed drive systems, (ii) is designed primarily for smaller field developments and flow requirements with motor power requirements of less than 1.5 megawatts, (iii) is seal-less so as to eliminate internal fluid leakage to the environment through dynamic seals, and (iv) is flexible and modular so as to allow for its incorporation in a large variety of applications, including boosting, seawater injection, water separation and fluid transport. A desirable system would also be capable of handling multiple types of fluids and fluid phases.

A subsea pump with the above characteristics could become a key component in systems that would enable:

Brownfield development of mature fields;
Development of greenfields with low initial pressures;
Injection of separated water from production fields;
Early production of discovered hydrocarbons;
Injection of raw seawater;
Subsea storage;
Deep heavy oil production;
Long-tie backs and flow assurance; or
Gas compression and seawater dewpointing/dehydration.

Auxiliary applications, crucial to well-functioning subsea factory concepts being pursued by many oil and gas operators, include:

- Active cooling pump using seawater or coolant in a loop to control temperatures of flows to and from the well, pipelines (e.g. "cold flow" technology) or equipment;
- Condensate pumping to host/shore in relation to subsea gas wells;
- Re-injection of oil into the flow to host/surface, post subsea separation systems;
- Injecting condensate to stabilize wet-gas compressors; and
- Wet-gas boosting.

SUMMARY OF THE INVENTION

The embodiments of the present invention herein encompass a unique low cost and efficient submersible single phase or multiphase fluid pumping or compressor system for operating submersed in a body of water and incorporates a permanent magnet coupling and hydraulic coupling system and an integrated variable speed drive functionality. The novelty of the concept includes the integration of a unique variable speed torque transmitting pressure barrier system, containing a magnetic coupling design with hydraulic coupling and impeller technology modified to efficiently operate in conjunction with a magnetic coupling for long-term subsea usage in a manner that has not been tried before. Integration of the above torque transmitting coupling system makes it possible to remove all auxiliary systems except the power string and will enable longer step outs than currently possible with existing technology.

In a preferred embodiment, the pumping system described comprises a liquid-filled standard electric motor transmitting torque to a single-phase or multiphase centrifugal pump via a sophisticated combined magnetic and hydraulic coupling system. The system incorporates a unique combination of (i) specially designed permanent magnetic coupling system to transfer torque between the main electric motor and the main pump or compressor with an integrated cooling, pressure compensating and lubrication system that also serves as a pressure barrier and (ii) a small pump impeller and a turbine wheel embedded in a hydraulic coupling system to transfer torque between the main electric motor and the main pump or compressor. The system also incorporates an actuating system connected to internal guide vanes that control the liquid flow between the small pump and turbine wheels of the coupling and hence the torque and speed.

The combination of the integrated permanent magnetic coupling and a hydrodynamic coupling serves as a combined pressure barrier and torque converter for the system. This combination serves two main functions.

First, the system hermetically separates the pumped process fluid from the electric motor fluid and surrounding seawater by means of a non-contact magnetic coupling and a static pressure barrier rated to take up towards 1035 bar differential pressure. The barrier created by the system removes the need for a mechanical seal and the need for barrier fluid lubrication of the seal.

Second, the hydraulic torque-coupling serves as a non-contact pump and turbine system that provides variable speed and soft-start functionality as well as complete torque control over the full range of speeds.

The integration of these two functions into a single system ensures cooling, lubrication, reliability and stability in a manner not realized or available before.

Specific benefits gained with the preferred embodiment of the invention include:

- The electric motor compartment does not need to be designed for well shut-in pressures. As a result, the casing of the motor can be designed to lower pressure requirements and the motor can be greatly standardized due to the hermetic static seal offered by the permanent magnetic coupling.
- Because the motor housing for the system is pressure compensated to the seabed pressure by means of an external pressure compensating device, the system eliminates the need for both (i) high pressure and medium/high voltage penetrators for the main power supply of the electric motor and (ii) high pressure, low voltage signal penetrators for the instrumentation signals in the motor/coupling area.
- The design minimizes the number of critical static seals in the pump or compressor system.
- The replacement of costly topside high pressure units (HPU) equipment and the associated hydraulic umbilical with a small low volume external pressure compensator and integrated cooling system.
- The motor and the cooling fluid can stay 100% free from process contamination.
- The pump/compressor unit can operate with more than the rotational speed of the motor generated by the feed frequency, giving reduced liquid induced friction losses in the motor. Lower friction losses offset historical expected efficiency losses common to the use of hydraulic couplings at high speeds.
- No topside supply of barrier fluid is needed for any single-phase or multiphase pumping operation. Barrier fluid is only needed subsea for highly contaminated process fluids or when bearing lubrication and magnetic coupling cooling is not possible. For these cases, the motor compartment and the cooling fluid would continue to still be 100% clean and free of process contamination.
- The pump/compressor module has a built-in soft start through its hydrodynamic coupling dynamics that provides a smooth mechanical start and reduces the need for high starting currents. Furthermore, no topside variable speed drive (VSD) is needed as shaft speed alterations are achieved through a standard actuator controlling the guide vanes of the hydrodynamic coupling. The pump/compressor inherently speeds up or down to keep power constant if torque is lowered or increased due to variations in gas content.
- The system requires lower breakaway torque at start-up, as the motor can start with no load applied and for vertical installation only the electric motor weight will affect the breakaway torque. Consequently, the electric cabling sizes can be much reduced. In the pump start-up phase, the full potential of the electrical motor generated torque is available, if necessary.

The preferred embodiment described herein, with the above described benefits, results in a unique seal-less and topside-less pumping system that can operate in harsh subsea environments without the need for costly and fragile mechanical shaft seals, complex barrier fluid systems, large topside hydraulic pressure units and variable speed drives. The system is particularly beneficial to smaller field developments, niche-pumping applications, sensitive environmental conditions where the potential of leaking seals would be problematic and applications where larger and more complex field development solutions using existing technology are needed or desirable. The system described herein is highly flexible and adaptable and capable of being used to boost oil and gas, inject or separate water, pump multiphase fluids efficiently and act as a cooler for other subsea applications.

BRIEF DESCRIPTION OF THE DRAWINGS

A better understanding of the present invention can be obtained when the following detailed description of the disclosed embodiments is considered in conjunction with the following drawings, in which.

DESCRIPTION OF THE PREFERRED EMBODIMENTS OF THE INVENTION

Figure 1:
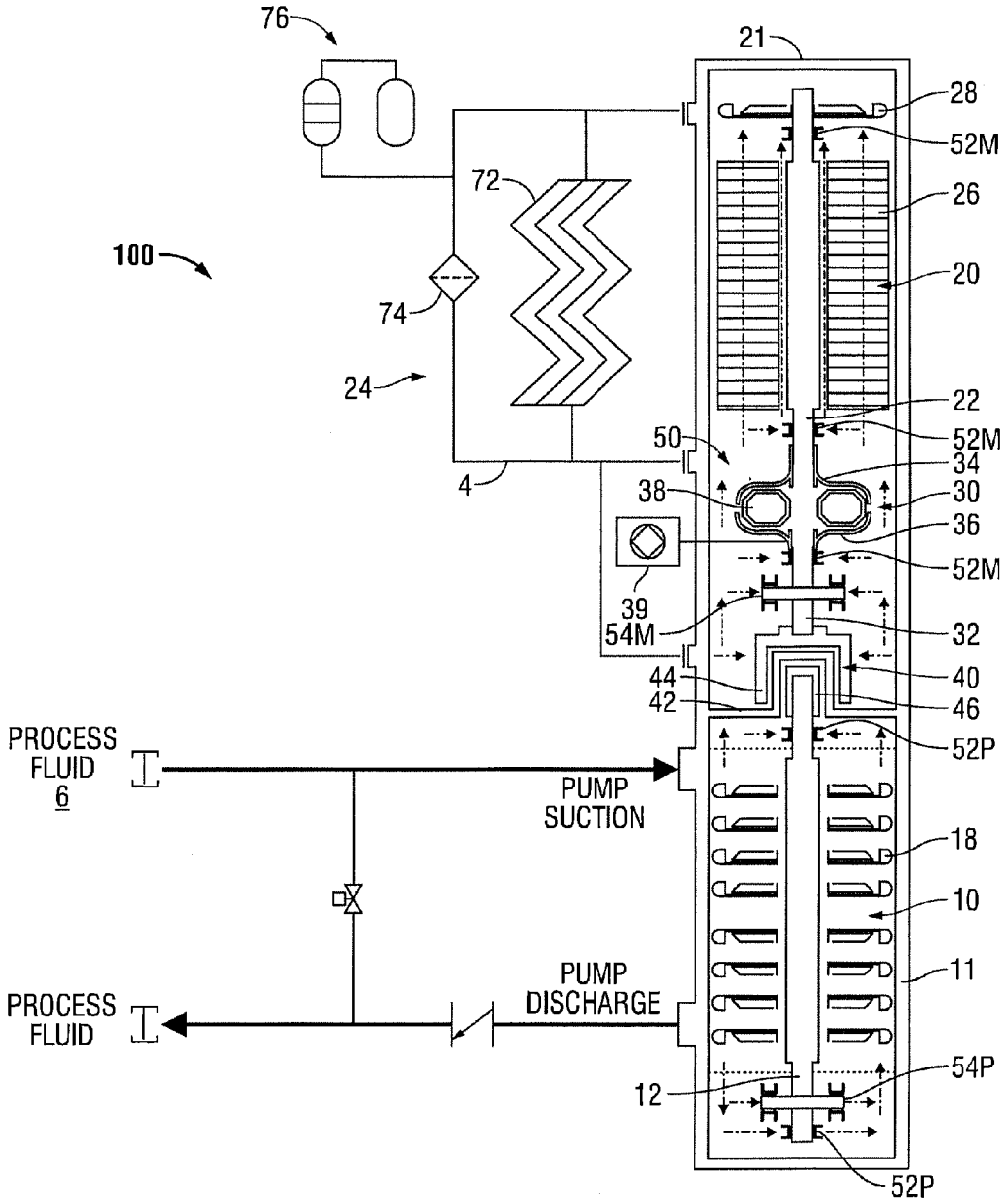
FIG. 1 is a schematic illustration of a preferred embodiment of the present invention showing a pump section joined to a motor section via a magnetic coupling and a hydrodynamic coupling.

A preferred embodiment of the present invention will now be described with reference to FIG. 1. The system, generally referred to as 100, includes a pump or compressor 10, preferably either a single or multistage pump or compressor, driven by a motor 20, typically an electrical motor, via a torque-transmitting assembly 50 comprising a hydrodynamic coupling 30 and a magnetic coupling 40.

The motor 20, hydrodynamic coupling 30 and a first portion of the magnetic coupling 40 are contained in a drive unit compartment 21 and a second portion of the magnetic coupling 40 and the pump or compressor 10 are contained in a boosting unit compartment 11. The pump or compressor 10 preferably includes a pump hydraulics pump cartridge or a compressor thermodynamics cartridge 18. Preferably, the system 100 includes a variable speed drive functionality in addition to a soft start feature. The entire boosting system 100, including all auxiliary systems, are designed for submersible usage (subsea applications).

The combination of the magnetic coupling 40 with the hydrodynamic coupling 30 provides a unique aspect of the torque-transmitting assembly 50. The magnetic coupling 40 is a device capable of transmitting force through space without physical contact by using magnetic forces to perform work in a rotary manner. Preferably, the magnetic coupling 40 includes a driver portion having a magnet 44 mounted to the lower end of the stub shaft 32 and a follower portion having magnet 46 mounted to an upper end of the pump shaft 12.

The magnetic coupling 40 separates the process side of the pump/compressor 10 from the electrical motor 20 side through the pressure containment shell 42. The drive unit compartment 21 with the pressure containment shell 42 comprises a hermetically sealed container around the electrical motor 20, the hydrodynamic coupling 30 and the driver portion of the magnetic coupling 40. The pressure containment shell 42 assures a clean cooling and lubricating fluid 4 in the drive unit compartment 21 without any risk of contamination caused by the process fluid 6. The magnetic coupling 40 can be of the synchronous or asynchronous type depending on the application. Magnetic couplings 40 are well known to those skilled in the art of seal-less rotodynamic boosting system development. One example of a suitable magnetic coupling is disclosed in applicant's co-pending U.S. application Ser. No. 14/516,079. This unique magnetic coupling eliminates the need for seals as leak barriers and provides a unique process for sealing the motor assembly, reduces risks of leakage of process fluids and enables the system to operate at extreme water depths without risk of environmental leaks.

The pump/compressor shaft 12 is driven by magnetic coupling 40 between a follower portion magnet 46, pressure containment shell 42, and driver portion magnet 44 which is rotated via stub shaft 32 by hydrodynamic coupling 30 via rotation of the shaft 22 of the motor 20.

The torque-transmitting system 50 is mechanically separated. The hydrodynamic coupling 30, as well as the driver portion 44 of the magnetic coupling 40, is mechanically separated from the follower portion 46 of the coupling 40, and hence it mechanically separates the pump/compressor 10 from the motor 20. This minimizes the load on bearings and shaft since it will be only the weight of the motor rotor 26 and the hydrodynamic coupling 30 that generates the breakaway torque. The required torque generated by the motor 20 is transmitted through electromagnetic forces to the pump/compressor 10.

The magnetic coupling 40 and the hydrodynamic coupling 30 are connected through a stub shaft 32. Each coupling component 30, 40 generates both axial and radial forces. Therefore, to handle the generated forces radial bearings 52M and thrust bearings 54M are mounted onto the stub shaft 32. As shown in FIG. 1, preferably at least one radial bearing 52M is mounted on a motor drive shaft 22 located above the stub shaft 32. Additionally, the pump/compressor 10 preferably includes upper and lower radial bearings 52P and a thrust bearing arrangement 54P.

Figure 3:
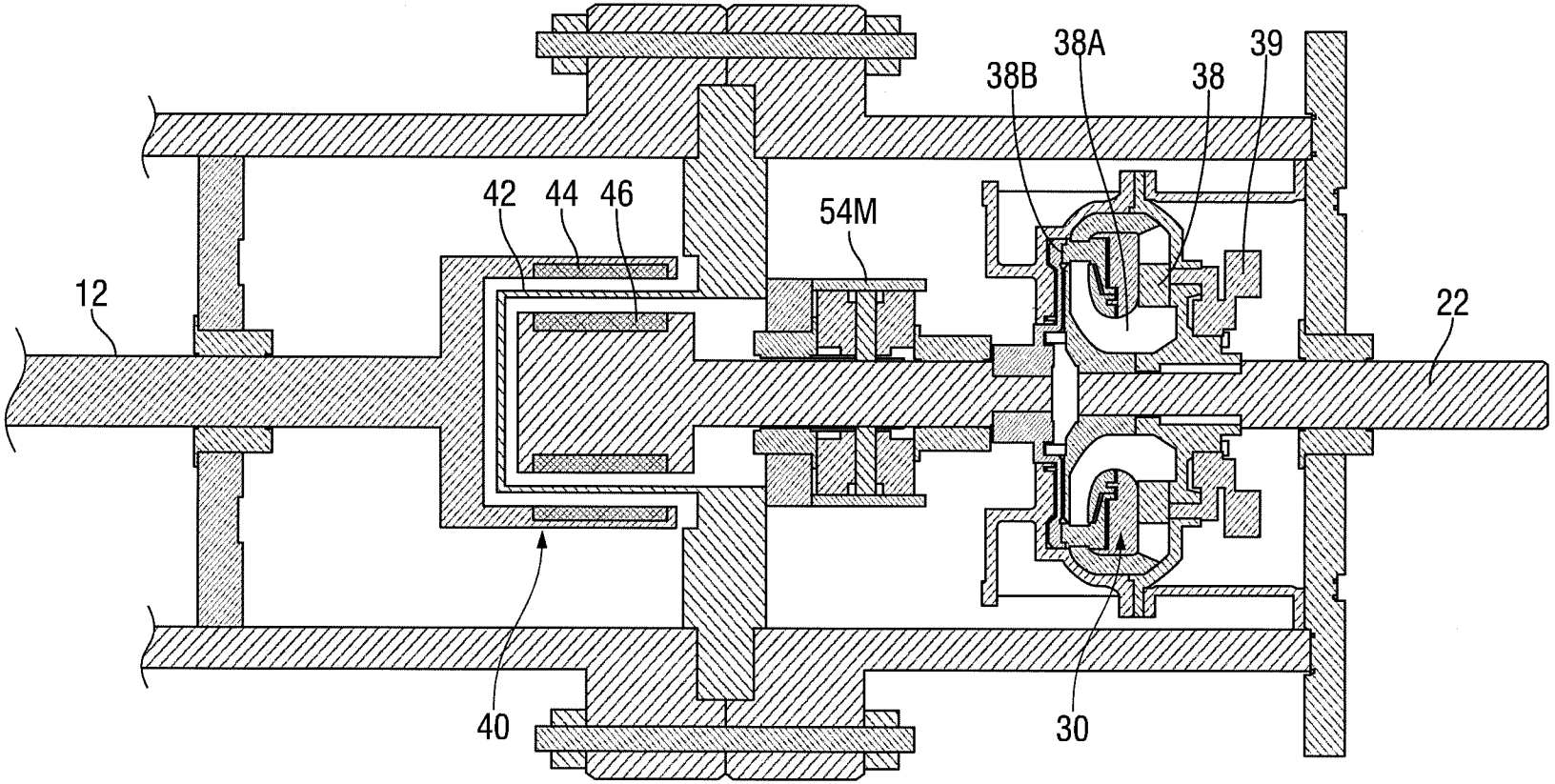
FIG. 3 is a view in section showing the general arrangement of the motor shaft, hydrodynamic coupling, magnetic coupling and pump/compressor shaft according to a preferred embodiment.

The hydrodynamic coupling 30 transmits the power generated by the electrical motor 20 via the magnetic coupling 40 to a pump/compressor shaft 12. The functionality of the hydrodynamic coupling 30 is based on three main components: an impeller 34, a turbine 36 and several guiding vanes 38 positioned within a housing. Hydrodynamic couplings 30 are well known to those skilled in the art of fluid couplings. With reference to FIG. 3, the impeller 34 has a plurality of impeller vanes 38A and the turbine 36 has a plurality of turbine vanes 38B. The impeller 34 and turbine 36 are preferably arranged in facing relationship to one another in the enclosed housing. The hydrodynamic coupling 30 provides power transmission based on an indirect operating principle. The driven impeller 34 transfers the introduced mechanical energy from the motor 20 to kinetic energy in fluid flow. The shape of the impeller vanes 38A forces the fluid flow in the direction of the turbine vanes 38B resulting in a net force causing a torque which causes the turbine 36 to rotate in the same direction as the impeller 34. The higher energy fluid flows centrifugally from the driven impeller 34 to the turbine 36 where the reconversion to mechanical energy takes place. The power is transferred from the impeller 34 to the turbine 36 without any direct contact. The amount of torque transmitted from the motor 20 to the pump/compressor 10 depends on the torque required by the pump/compressor application itself and the losses generated in the magnetic coupling 40. The position of the guiding vanes 38 supporting the turbine 36 with energized fluid controls the torque transmitted.

In the preferred embodiment, the hydrodynamic coupling 30 can be operated in three modes: constant speed mode, constant power mode and combined mode. In the constant speed mode, the power transmitted by the hydrodynamic coupling 30 is adjusted through internal guide vanes 38 by controlling the fluid 4 to the turbine 36 through an actuator 39. The type of actuator may be either electric or hydraulic. In the constant power mode, the hydrodynamic coupling 30 is operated with fixed guide vanes 38 and the speed is free to vary based on the required pump torque. The combined mode is an optimized mode where the constant speed mode and the constant power mode combine their functionality to meet all possible operating points.

In the preferred embodiment, a unique control system is embedded within the Hydromag coupling system for guide vane positioning. This control system includes hardware in the form of an electric or hydraulic actuating mechanism 39 as well as software installed on electric circuitry. The objective of the control system is two-fold: (1) protect the pump/compressor unit and (2) ensure ideal performance within the pump/compressor unit duty range.

The primary objective is to protect the system from being overloaded with excessive torque (single-phase or multiphase applications) or avoid the pump operating close to or beyond the surge line (multiphase applications). In this context, the control system will require two main inputs: actual pump shaft speed and guide vane position. From mapping this input with databases of pump test data (torque, speed, power, guide vane position), the control system output is a new guide vane position if the pump/compressor is venturing into overloading (excessive torque) or unstable over-speeding (surge/low torque) modes.

Secondly, the objective is to ensure that the pump/compressor operates within the targeted duty range (operating envelope) or is even adjusted to meet a certain duty point. In this context, the control system will have guide vane position and shaft speed as input, compare this with databases of actual test data and provide the ideal guide vane position for the wanted duty area and/or the area that gives the best efficiency or maximum torque (Note: the maximum torque condition in the Hydromag unit occurs at high speed conditions and is dependent on the hydraulic or the thermodynamic selection. The maximum viscous loss condition is when the magnetic losses in the Hydromag unit is at its lowest, which is at maximum speed). In some cases, the first and second objectives essentially mean the same, depending on safety margins. The inherent variable speed feature of the hydraulic coupling operating in constant power mode (at a specific guide vane position) assures for that the operating envelope protection mode always is activated in case the pump/compressor experiences inlet fluid conditions which creates upset conditions.

In traditional pump systems operated by electrical VFD's, one can avoid this control system and scenario by analyzing and acting on torque and power measurements directly from the VFD, knowing that the relationship between torque, speed and power is described in well-known equations. This is quite standard. However, as applicant's system does not have this VFD, and as the magnetic coupling is very sensitive to excessive torque, this control system becomes important for safe and efficient operation of the subsea pump system. Preferably, the logic of the control system is subsea, as response times may be too long to depend on any signal processing/logic topside.

The torque-transmitting assembly 50 generates both viscous and electromagnetic losses. To cool off these losses an internal flow network system 24 is used. The flow network system 24 also assures sufficient lubrication of the magnetic coupling 40 (if equipped with internal bearings), the hydrodynamic coupling 30, the radial bearings 52M and the axial bearing 54M in the section above the pressure containment shell 42. Additionally, a cooling circulation impeller 28 may be mounted to an upper end of the motor shaft 22.

The pressure containment shell 42 in the magnetic coupling 40 isolates the process fluid 6 from the cooling and lubricating fluid 4. This assures a 100% clean cooling fluid 4 at all times. By isolating the process fluid, the system is able to operate in sensitive environmental conditions. To further improve the quality of the cooling fluid 4, the flow network system 24 filters part of the cooling flow 4 through a filter 74 mounted in parallel to a cooling coil 72. Preferably, a fractional motor cooling flow 4 is continuously filtered. The flow network system 24 preferably includes a fluid pressure compensator 76. The flow network system 24 includes at least one inlet and at least one outlet with the drive unit compartment 21 to provide circulating cooling fluid 4 to the components contained within the drive unit compartment 21.

One of the features of the torque-transmitting assembly 50 is the ability to increase the operating speed of the pump/compressor 10 up to two times the motor speed (in the combined control mode). A reduction in motor speed reduces significantly the viscous losses generated in the motor 20. The viscous motor loss is the main loss contributor to the total losses in flooded motors. More specifically, in multiphase pumping systems, the pump speed frequently needs to be in the 4000-6000 rpm range, which can cause losses higher than 400 kW in 3000 kW systems. The viscous losses in the motor are proportional to the motor speed to the power of three (viscous loss motor$\propto$motor speed$^3$). A reduction in motor speed with up to two times will therefore reduce the viscous motor losses with up to eight times. This reduction in motor losses significantly increases the overall efficiency of the boosting system. In multiphase applications the continuous torque-speed control of the torque transmitting assembly in the combined control mode automatically handle the natural torque fluctuations that appear due to variations in the gas volume fractions (GVF) of the process fluid. The ability to handle large variations in GVF increases the flexibility of the system and enables it to be used for both single and multiphase applications in an economic and efficient manner.

The unique combination of the hydrodynamic coupling in series with a magnetic coupling driven by an electrical motor generates an efficient variable speed pump system that is independent of the process pressure and can operate with constant pressure surrounding the components with respect to the ambient sea pressure. This will guarantee 100% control of the internal flow network that lubricates and cools the components themselves since the differential pressure always will be the same over respective component independent of the process pressure. Furthermore, the system's combination of a centrifugal pump with the ability to spin faster than the speed of the motor with up to two times due to the hydrodynamic coupling feature allows for a substantial reduction in the power requirements for the system and increased motor efficiencies. Previously, conventional analysis would not have thought to combine a high rpm motor with a smaller centrifugal pump due to inherent viscous losses that would be expected. Furthermore, this combination would not be obvious for a typical top-side atmospheric environment, where electric motors do not see high pressures but are cooled by surrounding air and viscous losses are not an issue to consider. Also, the pump and its failure prone seals are normally easier and less expensive to repair topside than subsea and therefore less critical. The added costs of having two coupling systems combined does not outweigh the benefits. The cost and complexity of repairs subsea, however, necessitates alternative approaches not previously considered. This combination of a low speed motor with a hydrodynamic coupling and a magnetic coupling in series also enables the system to be smaller in scale and complexity so as to enable subsea boosting and pumping to be economically feasible for small field developments.

Another feature is the inherent soft start functionality of the hydrodynamic coupling 30 that makes it possible to operate the pump/compressor 10 with a direct start of the electrical motor 20. The ability to have soft start functionality substantially reduces the power requirements of the system and the associated costs of providing increased power. The lower power requirements also enable the system to be economically applied to smaller and more marginal fields. The ability to have a soft start is due to the hydrodynamic system behavior of the impeller 34, the turbine 36 and the guide vanes 38 in the hydrodynamic coupling 30. Initially, if the guide vanes 38 are in the closed position there is no torque generated through the turbine 36, only internal recirculation in the impeller 34. Right after the direct start of the motor 20, the actuator 39 gradually opens the guide vanes 38 to the pump parking speed or to the wanted opening position to meet the required pump torque and speed. This starting procedure makes the pump started with a motor direct start via the torque transmitting system comparable to a pump start through a variable speed drive (VSD). Accordingly, the cost and complexity of having a separate VSD is eliminated. Operating the system 100 this way also makes it possible to use the full potential of the motor 20 even at low pump speed (i.e., low rpm).

Even without the possibility to operate the guide vanes 38, the pump/compressor start will be more of the soft start type, due to the inherent time delay of the hydrodynamics in the hydrodynamic coupling 30. That is, it will take some time to build-up a flow in the impeller 34 to drive the torque-generating turbine 36 that will drive the pump/compressor 10 through the magnetic coupling 40.

Figure 2:
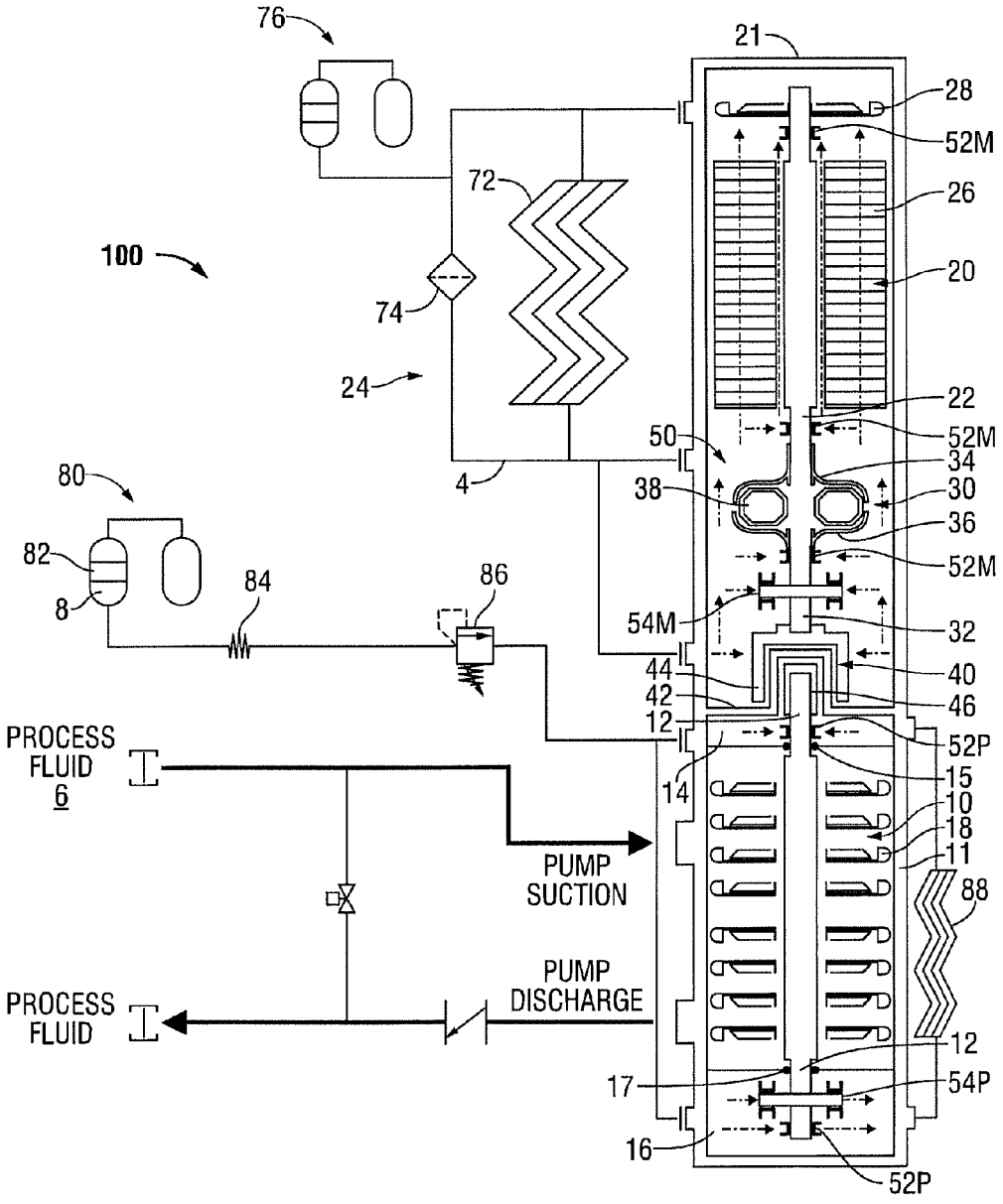
FIG. 2 is a schematic illustration of another embodiment of the present invention similar to FIG. 1 but having a mechanical seal arrangement in the pump section forming sealed chambers in communication with a barrier fluid system.

As shown in FIG. 1, the radial and thrust bearings 52P, 54P in the pump section of the system 100 are lubricated by the process fluid 6. However, these radial bearings 52P and thrust bearings 54P cannot be suitably lubricated by the process fluid 6 in cases where the process fluid 6 is very contaminated and in multiphase applications where gas is one of the components in the process fluid 6. In such instances, it is preferred to use a modified system 100' as shown in FIG. 2. It is to be understood that like reference numbers in FIG. 2 and FIG. 1 refer to the same components and the related discussion with respect to the component in FIG. 1 equally pertains to the like component in FIG. 2, unless stated otherwise.

As in the prior embodiment, the system 100 includes a pump/compressor 10 driven by a motor 20 via a torque-transmitting assembly 50 comprising a hydrodynamic coupling 30 and a magnetic coupling 40. Preferably, the system 100' includes a variable speed drive functionality in addition to a soft start feature. The entire boosting system 100' including all auxiliary systems are designed for submersible usage (subsea applications). The system 100' further comprises the following similar elements as in system 100: a pump/compressor shaft 12, a stub shaft 32, an impeller 34, a turbine 36 and several guiding vanes 38 of the hydrodynamic coupling 30, a pressure containment shell 42, an electrical actuator 39, and upper and lower radial bearings 52P and a thrust bearing arrangement 54P.

The pressure containment shell 42 in the magnetic coupling 40 isolates the process fluid 6 from the cooling and lubricating fluid 4. This assures a 100% clean cooling fluid 4 at all times. To further improve the quality of the cooling fluid 4, the flow network system 24 filters part of the cooling flow 4 through a filter 74 mounted in parallel to a cooling coil 72. Preferably, a fractional motor cooling flow 4 is continuously filtered.

As shown in FIG. 2, the pump/compressor 10 preferably includes upper and lower radial bearings 52P and a thrust bearing arrangement 54P. An upper sealed chamber 14 of the pump/compressor 10 is defined by the pressure containment shell 42, an upper portion of the booster unit compartment 11 and an upper divider comprising a mechanical seal 15. The mechanical seal 15 forming a seal with the pump shaft 12. The upper radial bearing 52P is contained within the upper sealed chamber 14.

A lower sealed chamber 16 of the pump/compressor 10 is defined by a lower portion of the booster unit compartment 11 and a lower divider comprising a mechanical seal 17. The mechanical seal 17 forming a seal with the pump shaft 12. The lower radial bearing 52P and thrust bearing arrangement 54P is contained within the lower sealed chamber 16.

The sealed upper and lower chambers 14 and 16 of the pump 10 are in communication with a barrier fluid system 80. The barrier fluid system 80 comprises a barrier fluid 8, a pressurized tank 82, a check valve 84, a pressure regulating valve 86 and, if needed, a cooler 88. The purpose of this barrier fluid system 80 is to assure a clean lubrication of the bearings 52P and 54P. None of the above system designs need topside supply of barrier fluid 8. In the case of mechanical seal failure, the motor 20 does not have to be shut down as long as the barrier fluid supply is working. Also the maintenance of this system after a mechanical failure is much easier because it is only the main pump/compressor 10 that will need to be disassembled. This design also minimizes the spare parts required; instead of a spare motor-pump unit only a pump/compressor cartridge will be required. The design allows for reduced down-time, less complex service activity and lower overall operating and maintenance costs.

A unique feature of the system is generated through the specific combination of sub-components in the system where a hydrodynamic coupling 30 is arranged in series with a magnetic coupling 40. There are several benefits gained through this arrangement:

- The motor 20, including the cooling fluid 4, is free from process contamination.
- The pump/compressor 10 can operate at twice the rotational speed of the motor 20.
- The pump/compressor 10 has an inherent soft start through the hydrodynamic coupling 30.
- No top-side variable speed drive is needed to cover a large operating range; this is achieved through a linear actuator 39 controlling the hydrodynamic coupling 30.
- The motor casing can be designed according to lower pressure requirements; this also includes all the auxiliary components such as: hydrodynamic connectors, high voltage connectors, signal connectors, cooling tubing, filter housing and compensators.
- The system design requires lower breakaway torque at start-up.
- In the pump/compressor start-up phase, the full potential of the electrical motor 20 generated torque is available.
- No topside supply of barrier fluid 8 needed for any case.
- Barrier fluid 8 is only needed subsea for highly contaminated process fluids P or when bearing lubrication and magnetic coupling 40 cooling is not possible. For these specific cases, the motor compartment 21 and the cooling fluid 4 will still be 100% clean and free of process contamination.

The pressure containment shell in the magnetic coupling 40 isolates the process fluid 6 from the cooling and lubricating fluid 4. This assures a 100% clean cooling fluid 4 for all times. This is especially important for pumps/compressors 10 that are operating with hydrodynamic bearings. To further improve the quality of the cooling fluid 4, this specific flow network system 24 filters part of the cooling flow 4 through a filter 74 mounted in parallel to the cooling coil 72.

One of the features of the hydrodynamic coupling 30 is that it generates a speed increase if needed between the electrical motor 20 and the pump/compressor unit 10 and a speed increase of up to two times is possible. This is important in maintaining a high efficiency when operating the pump/compressor 10 at high rotational speeds. At high rotor 26 speeds of the motor 20, up to 90% of the total losses in the boosting system can be generated in the electrical motor compartment 21. The main contributor to the motor losses at high speed is the viscous losses. By reducing the speed of the motor 20 by a factor of two, the losses generated through viscous work will be reduced eight times ($0.5^3$). High rotational speeds are required when operating at high gas volume fractions (GVF) (i.e., in the range from 30% to 100% GVF) to be able to generate sufficient differential pressures in the overall system.

Through the inherent soft start system in the hydrodynamic coupling 30, the pump 10 is started softly even if the motor 20 is started through a direct start. This is due to the hydrodynamic behaviour internally in the hydrodynamic coupling 30 and in-between the three main components in the hydrodynamic coupling 30: the centrifugal impeller 34, the guide vanes 38 and the turbine 36. During a direct start of the motor 20, the centrifugal impeller 34 internally in the coupling 30 is not able to instantaneously generate the required shaft power to the pump 10. This is due to the short, but not insignificant, time it takes to build up the flow pattern in the hydrodynamic coupling 30. The sequence to generate a sufficient shaft power is as follows: the centrifugal impeller 34 builds up a sufficient flow and pressure that will drive the turbine 36 via the guiding vanes 38. The turbine 36 in turn then generates a torque that overcomes the breakaway torque and starts to spin the pump/compressor 10.

The hydrodynamic coupling 30, if controlled by an actuator 39, can also be used to increase the pump operating window by changing the flow-pressure characteristics of the fluid 4 entering into the turbine 36. This is done by regulating the position of the guide vanes 38 that are controlling the shaft power to the main pump 10 at a fixed motor speed. Depending on the guide vane position the turbine 36 generates a specific shaft power to the main pump/compressor 10; the speed of the pump/compressor 10 then depends on the required torque of the pump hydraulics itself. This functionality considerably simplifies the control system of the pump/compressor due to the inherent torque control/regulating mechanism of the hydrodynamic coupling. This feature also makes it possible to use a traditional speed control system even for highly fluctuating multi-phase flows.

The pressure containment shell isolating the process side of the main pump 10 from the cooling fluid 4 in the motor compartment 21 also handles the shut-in pressure from the process. This result means that the motor casing, including all pressure components in the motor cooling system, can be designed to a lower pressure rating than the main pump/compressor 10 only with the requirement to meet the required pressure of the environment into which the pump/compressor module 10 is installed. This design also will significantly reduce the weight of the electrical motor casing and the auxiliary systems such as high voltage connectors, hydraulic connectors and of the cooling system. It will also lead to a considerably efficiency increase of the electrical motor cooling system due to the reduced wall thickness required in the cooling tubes. The wall thickness in the cooling tubes is normally one of the most size and performance driving parameters in the design of a passive subsea cooling system.

The magnetic coupling 40 physically separates the main pump/compressor 10 from the motor 20 and coupling arrangement. This configuration implies that only the weight of the motor rotor 26 will generate the required breakaway torque during start-up of the pump/compressor system 10. This result is achieved by mechanically isolating the magnetic coupling 40 and the main pump/compressor 10 from the rest of the system by closing the flow through the guide vanes 38 for a limited time.

It is possible to control the position of the guide vanes 38 during start-up to take advantage of the characteristics of the motor 20, that is, to make sure that the main pump/compressor 10 is started when the motor 20 is generating maximum torque.

The magnetic coupling 40 generates a leakage free environment. There is no mechanical seal leakage from the motor cooling fluid 4 (no mechanical seals are connected to the motor compartment 21). The elimination of seals improves reliability, provides a more robust fluid barrier and increases environmental safety.

While the invention has been described in detail above with reference to specific embodiments, it will be understood that modifications and alterations in the embodiments disclosed may be made by those practiced in the art without departing from the spirit and scope of the invention. All such modifications and alterations are intended to be covered. In addition, all publications cited herein are indicative of the level of skill in the art and are hereby incorporated by reference in their entirety as if each had been individually incorporated by reference and fully set forth.

We claim:

1. A boosting system for subsea use comprising:

a submersible electric motor having a shaft;

a hydrodynamic coupling comprising an input portion and an output portion, the input portion connected to the motor shaft;

a magnetic coupling comprising a driver portion and a follower portion magnetically coupled together;

a stub shaft connected to the hydrodynamic coupling output portion and connected to the magnetic coupling driver portion;

a booster unit having a shaft operatively connected to the magnetic coupling follower portion;

a hermetically sealed container filled with liquid and encompassing the magnetic coupling driver portion, hydrodynamic coupling and electric motor, the magnetic coupling follower portion being separated from the magnetic coupling driver portion by a pressure containment member of the hermetically sealed container; and a pressure compensator for balancing the pressure in the hermetically sealed container with an ambient subsea pressure surrounding the hermetically sealed container.

2. The system of claim 1, wherein the hydrodynamic coupling input and output portions comprise an impeller, a turbine and a plurality of guide vanes.

3. The system of claim 2, further comprising an actuator controlling the positioning of the guide vanes of the hydrodynamic coupling.

4. The system of claim 1, further comprising a flow network system for circulating a cooling fluid throughout the hermetically sealed container.

5. The system of claim 4, wherein the flow network system is in hydraulic communication with an external filter and a cooling coil.

6. The system of claim 4, wherein the flow network system is an internal system.

7. The system of claim 4, wherein the flow network system circulates the cooling fluid around the magnetic coupling driver portion coupled to the hydrodynamic coupling output portion as well as around the hydrodynamic coupling and as well as around the electric motor to lubricate and cool the magnetic coupling driver portion and hydrodynamic coupling and electric motor in the hermetically sealed container.

8. The system of claim 4, further comprising a plurality of bearings within the hermetically sealed container coupled to the motor shaft, the hydrodynamic coupling and the magnetic coupling driver portion, wherein the flow network system circulates the cooling fluid to lubricate and cool the plurality of bearings in the hermetically sealed container.

9. The system of claim 8, wherein the hydrodynamic coupling uses a fluid to transfer energy across the hydrodynamic coupling, and the fluid used to transfer energy across the hydrodynamic coupling is the cooling fluid.

10. The system of claim 1, further comprising:

an enclosed booster unit compartment encompassing the magnetic coupling follower portion, booster unit and booster unit shaft, wherein the pressure containment member extends between the driver portion and the follower portion of the magnetic coupling, and comprises part of the booster unit compartment and part of the hermetically sealed container.

11. The system of claim 10, wherein the enclosed booster unit compartment is a pressure containment shell.

12. The system of claim 11, further comprising:

an upper radial bearing on an upper portion of the booster unit shaft;

a lower radial bearing on a lower portion of the booster unit shaft;

a thrust bearing on a portion of the booster unit shaft; and wherein the upper and lower radial bearings and the thrust bearing are lubricated and cooled by a process fluid and the process fluid is also the fluid pumped through the booster unit.

13. The system of claim 11, further comprising:

an upper radial bearing on an upper portion of the booster unit shaft;

a lower radial bearing on a lower portion of the booster unit shaft;

an upper divider having an upper mechanical seal forming a seal with the upper portion of the booster unit shaft;

a lower divider having a lower mechanical seal forming a seal with the lower portion of the booster unit shaft;

wherein an upper sealed chamber of the pressure containment shell being defined by the upper divider having the upper mechanical seal, and a lower sealed chamber of the pressure containment shell being defined by the lower divider having the lower mechanical seal; and wherein the upper radial bearing is in the upper sealed chamber and the lower radial bearing is in the lower sealed chamber.

14. The system of claim 13, further comprising a thrust bearing on a portion of the booster unit shaft.

15. The system of claim 14, wherein the thrust bearing is in the lower sealed chamber.

16. The system of claim 13, further comprising a barrier fluid system circulating a barrier fluid in the upper and lower sealed chambers.

17. The system of claim 16, wherein the barrier fluid system comprises:

a pressurized tank and/or a subsea high pressure unit;

a check valve;

a pressure regulating valve; and a barrier fluid circulating system.

18. The system of claim 17, wherein the barrier fluid system further comprises a cooler.

19. A boosting system for subsea use comprising:

an enclosed shell divided into a sealed motor compartment and a booster unit compartment by a pressure containment member;

the motor compartment filled with liquid and containing an electric motor having a shaft, a hydrodynamic coupling, and a driver portion of a magnetic coupling;

the booster unit compartment containing a booster unit having a shaft operably connected to a follower portion of the magnetic coupling, the magnetic coupling follower portion being separated from the driver portion by the pressure containment member; and a pressure compensating device for balancing the pressure in the motor compartment with an external subsea pressure.

20. A subsea pressure booster system comprising:

an electric motor having a motor shaft;

an impeller arranged on a first end of the motor shaft;

a turbine;

a stub shaft;

a magnetic coupling driver portion, wherein the turbine is arranged on a first end of the stub shaft, facing the impeller but with a gap between the stub shaft and motor shaft, the arrangement of the turbine and impeller defining a hydrodynamic coupling, and the magnetic coupling driver portion at a second end of the stub shaft;

an actuator with variable speed and torque control of the hydrodynamic coupling between the motor shaft and the stub shaft;

a hermetically sealed container containing the electric motor, motor shaft, hydrodynamic coupling, stub shaft and magnetic coupling driver portion;

a liquid fluid filling the hermetically sealed container, the fluid being a combined hydrodynamic coupling fluid, coolant and lubricant;

a pressure compensator, arranged in a liquid fluid flow network system;

the subsea pressure booster system further comprising:

a magnetic coupling follower portion;

a pressure booster having a pressure booster shaft;

a booster compartment having a pressure containment member, wherein the magnetic coupling follower portion is facing the magnetic coupling driver portion, the pressure containment member is arranged between the magnetic coupling driver and follower portions, the booster compartment containing the magnetic coupling follower portion, the pressure booster shaft and the pressure booster.

21. The subsea pressure booster system of claim 20, wherein the actuator controls the speed of the pressure booster in a range from below the motor speed to twice the motor speed.

22. The subsea pressure booster system of claim 20, wherein the actuator comprises guide vanes with controllable position.

23. The subsea pressure booster system of claim 20, wherein the actuator comprises guide vanes with controllable position, the position of the guide vanes controls the speed and torque transmitted by the hydrodynamic coupling.

24. The subsea pressure booster system of claim 20, wherein the liquid fluid flow network system circulates a cooling fluid throughout the hermetically sealed container.

25. The subsea pressure booster system of claim 24, wherein the liquid fluid flow network system is in hydraulic communication with an external filter and a cooling coil.

26. The subsea pressure booster system of claim 24, wherein the liquid fluid flow network system is an internal system.

27. The subsea pressure booster system of claim 24, wherein the liquid fluid flow network system circulates the cooling fluid around the magnetic coupling driver portion coupled to the hydrodynamic coupling as well as around the electric motor to lubricate and cool the magnetic coupling driver portion, hydrodynamic coupling and electric motor in the hermetically sealed container.

28. The subsea pressure booster system of claim 24, further comprising a plurality of bearings within the hermetically sealed container coupled to the motor shaft, the hydrodynamic coupling and the magnetic coupling driver portion, wherein the liquid fluid flow network system circulates the cooling fluid to lubricate and cool the plurality of bearings in the hermetically sealed container.

29. A subsea pressure booster system comprising:

an electric motor having a motor shaft;

an impeller arranged on a first end of the motor shaft;

a turbine;

a stub shaft;

a magnetic coupling driver portion, wherein the turbine is arranged on a first end of the stub shaft, facing the impeller but with a gap between the stub shaft and motor shaft, the arrangement of the turbine and impeller defining a hydrodynamic coupling, and the magnetic coupling driver portion on an opposite end of the stub shaft;

an actuator, wherein the actuator comprises guide vanes with controllable position, the position of the guide vanes controls the speed and torque of the hydrodynamic coupling;

a motor compartment containing the electric motor, motor shaft, impeller, turbine, stub shaft and magnetic coupling driver portion, a liquid fluid filling the motor compartment, the fluid being a combined hydrodynamic coupling fluid, coolant and lubricant, a pressure compensator, arranged in a liquid fluid flow network;

the subsea pressure booster system further comprising:

a magnetic coupling follower portion;

a pressure booster having a pressure booster shaft; and a booster compartment having pressure containment member, wherein the magnetic coupling follower portion is facing the magnetic coupling driver portion, the pressure containment member is arranged between the magnetic coupling driver and follower portions, the booster compartment containing the magnetic coupling follower portion, the pressure booster shaft and the pressure booster, and whereby the actuator controls the pressure booster speed in a range from below the motor speed to twice the motor speed.

30. The subsea pressure booster system of claim 29, wherein the pressure compensator is arranged in a part of the liquid fluid flow network system that is external to the motor compartment.

31. The subsea pressure booster system of claim 29, wherein the speed range of the pressure booster, controlled by the actuator ranges from no speed to twice the motor speed.

32. The subsea pressure booster system of claim 29, wherein the motor compartment is a hermetically sealed container and the liquid fluid flow network system circulates a cooling fluid throughout the hermetically sealed container.

33. The subsea pressure booster system of claim 32, wherein the liquid fluid flow network system is in hydraulic communication with an external filter and a cooling coil.

34. The subsea pressure booster system of claim 32, wherein the liquid fluid flow network system is an internal system.

35. The subsea pressure booster system of claim 32, wherein the liquid fluid flow network system circulates the cooling fluid around the magnetic coupling driver portion coupled to the hydrodynamic coupling as well as around the hydrodynamic coupling and as well as around the electric motor to lubricate and cool the magnetic coupling driver portion, hydrodynamic coupling and electric motor in the hermetically sealed container.

36. The subsea pressure booster system of claim 32, further comprising a plurality of bearings within the hermetically sealed container coupled to the motor shaft, the hydrodynamic coupling and the magnetic coupling driver portion, wherein the liquid fluid flow network system circulates the cooling fluid to lubricate and cool the plurality of bearings in the hermetically sealed container.

37. A subsea pressure booster system comprising:

an electric motor having a motor shaft;

an impeller arranged on a first end of the motor shaft;

a turbine;

a stub shaft;

a magnetic coupling driver portion, wherein the turbine is arranged on a first end of the stub shaft, facing the impeller but with a gap between the stub shaft and motor shaft, the arrangement of the turbine and impeller defining a hydrodynamic coupling, and the magnetic coupling driver portion at an opposite end of the stub shaft;

an actuator comprising fixed guide vanes;

a motor compartment containing the electric motor, motor shaft, impeller, turbine, stub shaft and magnetic coupling driver portion;

a liquid fluid filling the motor compartment, the liquid fluid being a combined hydrodynamic coupling fluid, coolant and lubricant;

a pressure compensator, arranged in a liquid fluid flow network system;

the subsea pressure booster system further comprising:

a magnetic coupling follower portion, a pressure booster having a pressure booster shaft; and a booster compartment having a pressure containment member, wherein the magnetic coupling follower portion is facing the magnetic coupling driver portion, the pressure containment member is arranged between the magnetic coupling driver and follower portions, the booster compartment contains the magnetic coupling follower portion, the pressure booster shaft and the pressure booster.

38. The subsea pressure booster system of claim 37, wherein the pressure booster speed is higher than the speed of the motor.

39. The subsea pressure booster system of claim 37, wherein the pressure booster speed is up to two times higher than the speed of the motor.

40. The subsea pressure booster system of claim 37, wherein the motor compartment is a hermetically sealed container and the liquid fluid flow network system circulates a cooling fluid throughout the hermetically sealed container.

41. The subsea pressure booster system of claim 40, wherein the liquid fluid flow network system is in hydraulic communication with an external filter and a cooling coil.

42. The subsea pressure booster system of claim 40, wherein the liquid fluid flow network system is an internal system.

43. The subsea pressure booster system of claim 40, further comprising a plurality of bearings coupled to the motor shaft, the hydrodynamic coupling and the magnetic coupling driver portion within the hermetically sealed container, wherein the liquid fluid flow network system circulates the cooling fluid to lubricate and cool the plurality of bearings in the hermetically sealed container, and circulates the cooling fluid around the magnetic coupling driver portion coupled to the hydrodynamic coupling, around the hydrodynamic coupling and around the electric motor to lubricate and cool the magnetic coupling driver portion, hydrodynamic coupling and electric motor in the hermetically sealed container.

* * * * *